US008528638B2

(12) United States Patent
Dong

(10) Patent No.: US 8,528,638 B2
(45) Date of Patent: Sep. 10, 2013

(54) SINGLE WELL DUAL/MULTIPLE HORIZONTAL FRACTURE STIMULATION FOR OIL PRODUCTION

(75) Inventor: Shuxing Dong, Beijing (CN)

(73) Assignee: ConocoPhillips Company, Houston, TX (US)

( * ) Notice: Subject to any disclaimer, the term of this patent is extended or adjusted under 35 U.S.C. 154(b) by 464 days.

(21) Appl. No.: 12/953,001

(22) Filed: Nov. 23, 2010

(65) Prior Publication Data

US 2011/0127033 A1 Jun. 2, 2011

Related U.S. Application Data

(60) Provisional application No. 61/265,461, filed on Dec. 1, 2009.

(51) Int. Cl.
*E21B 33/12* (2006.01)
*E21B 43/24* (2006.01)
*E21B 43/267* (2006.01)

(52) U.S. Cl.
USPC ..... 166/263; 166/280.1; 166/303; 166/305.1; 166/306; 166/387

(58) Field of Classification Search
None
See application file for complete search history.

(56) References Cited

U.S. PATENT DOCUMENTS

| | | | | |
|---|---|---|---|---|
| 3,118,499 | A * | 1/1964 | Johnson et al. | 166/271 |
| 3,349,849 | A * | 10/1967 | Closmann | 166/285 |
| 3,353,602 | A * | 11/1967 | Geertsma | 166/303 |
| 3,455,392 | A * | 7/1969 | Prats | 166/303 |
| 3,938,590 | A | 2/1976 | Redford et al. | |
| 4,109,722 | A * | 8/1978 | Widmyer et al. | 166/281 |
| 4,127,172 | A | 11/1978 | Redford et al. | |
| 4,271,905 | A | 6/1981 | Redford et al. | |
| 4,550,779 | A * | 11/1985 | Zakiewicz | 166/248 |
| 5,085,276 | A * | 2/1992 | Rivas et al. | 166/303 |
| 5,131,471 | A | 7/1992 | Duerksen et al. | |
| 5,148,869 | A | 9/1992 | Sanchez | |
| 5,215,149 | A | 6/1993 | Lu | |
| 5,339,904 | A * | 8/1994 | Jennings et al. | 166/303 |
| 5,503,226 | A | 4/1996 | Wadleigh | |
| 5,890,536 | A | 4/1999 | Nierode et al. | |
| 7,248,969 | B2 | 7/2007 | Patzek et al. | |
| 7,422,063 | B2 | 9/2008 | Crichlow | |
| 2010/0263874 | A1 * | 10/2010 | Kosakewich | 166/308.1 |
| 2010/0276147 | A9 * | 11/2010 | Hocking | 166/303 |

FOREIGN PATENT DOCUMENTS

| | | |
|---|---|---|
| WO | 2008070990 | 6/2008 |

* cited by examiner

*Primary Examiner* — George Suchfield
(74) *Attorney, Agent, or Firm* — ConocoPhillips Company

(57) ABSTRACT

A method of producing oil which begins by drilling, casing and inserting a tubing string in a wellbore. The method then perforates both an upper portion and a lower portion of the casing to establish communication between the wellbore with a upper horizontal fracture and a lower horizontal fracture. A retrievable packer or a seal assembly is inserted horizontally between the tubing string and the casing and vertically between the upper horizontal fracture and the lower horizontal fracture for heat isolation. Steam is then injected into the wellbore both into the upper horizontal fracture and the lower horizontal fracture. Heavy oil is then produced from the lower horizontal fracture while injecting steam into the upper horizontal fracture.

6 Claims, 2 Drawing Sheets

SINGLE WELL DUAL/MULTIPLE HORIZONTAL FRACTURE STIMULATION FOR OIL PRODUCTION

CROSS-REFERENCE TO RELATED APPLICATIONS

This application is a non-provisional application which claims benefit under 35 USC §119(e) to U.S. Provisional Application Ser. No. 61/265,461 filed Dec. 1, 2009, entitled "SINGLE WELL DUAL/MULTIPLE HORIZONTAL FRACTURE STIMULATION FOR OIL PRODUCTION," which is incorporated herein in its entirety.

STATEMENT REGARDING FEDERALLY SPONSORED RESEARCH OR DEVELOPMENT

None

FIELD OF THE INVENTION

Method of producing oil from heavy oil.

BACKGROUND OF THE INVENTION

Heavy hydrocarbons in the form of petroleum deposits are distributed worldwide and the heavy oil reserves are measured in the hundreds of billions of recoverable barrels. Because of the relatively high viscosity, these crude deposits have extremely low mobilities and have low recoveries using conventional primary and secondary means. For many heavy oil fields, the only economically viable means of oil recovery is by the addition of heat and or solvent(s) to the oil deposit, which significantly decreases the viscosity of the oil and allows the oil to flow from the formation into the producing wellbore.

The most significant oil recovery problem with heavy oil, tar sands and similar hydrocarbonaceous material is the extremely high viscosity of the native hydrocarbons. At reservoir conditions, the oil viscosity ranges from 10,000 cp at the low end of the range to 25,000,000 cp plus at the high end. The viscosity of steam at injection conditions is about 0.020 cp to 10 cp, depending upon the temperature and pressure of the injected steam. Assuming similar rock permeability to both phases steam and oil, then the viscosity ratio provides a good measure of the flow transmissibility of the formation to each phase. Under the same pressure gradient, gaseous steam can therefore flow from 500,000 to 250,000,000 times easier through the material than the oil at reservoir conditions. Because of this viscosity ratio, it is imperative and critical to any recovery application that the steam be confined or limited to an area of the reservoir by a seal. This seal can be physical, hydraulic or pneumatic and essentially must provide a physical situation which guarantees no-flow of any fluid across an interface. This can be implemented by several means. Without this "barrier" the steam will bypass, overrun, circumvent, detour around the cold viscous formation and move to the producer wellbore.

SUMMARY OF THE INVENTION

A method of producing oil which begins by drilling, casing and inserting a tubing string in a wellbore. The method then perforates both an upper portion and a lower portion of the casing to establish communication between the wellbore with a upper horizontal fracture and a lower horizontal fracture. A retrievable packer or a seal assembly is inserted horizontally between the tubing string and the casing and vertically between the upper horizontal fracture and the lower horizontal fracture for heat isolation. Steam is then injected into the wellbore both into the upper horizontal fracture and the lower horizontal fracture. Heavy oil is then produced from the lower horizontal fracture while injecting steam into the upper horizontal fracture A method of producing oil which begins by drilling, casing and inserting a tubing string in a wellbore. The method then perforates both an upper portion and a lower portion of the casing to establish communication between the wellbore with a upper horizontal fracture and a lower horizontal fracture. A retrievable packer or a seal assembly is inserted horizontally between the tubing string and the casing and vertically between the upper horizontal fracture and the lower horizontal fracture for heat isolation. Steam is then injected into the wellbore both into the upper horizontal fracture and the lower horizontal fracture. Heavy oil is then produced from the upper horizontal fracture and the lower horizontal fracture through cyclic steam stimulation.

A method of producing oil which begins by drilling, casing and inserting a tubing string in a wellbore. The method then perforates both an upper portion and a lower portion of the casing to establish communication between the wellbore with a upper horizontal fracture and a lower horizontal fracture. A retrievable packer or a seal assembly is inserted horizontally between the tubing string and the casing and vertically between the upper horizontal fracture and the lower horizontal fracture for heat isolation. Steam is then injected into the wellbore both into the upper horizontal fracture and the lower horizontal fracture. Heavy oil is then produced from the upper horizontal fracture, the lower horizontal fracture or both fractures using a solvent and/or a solvent assisted steam processes.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Figure 1:
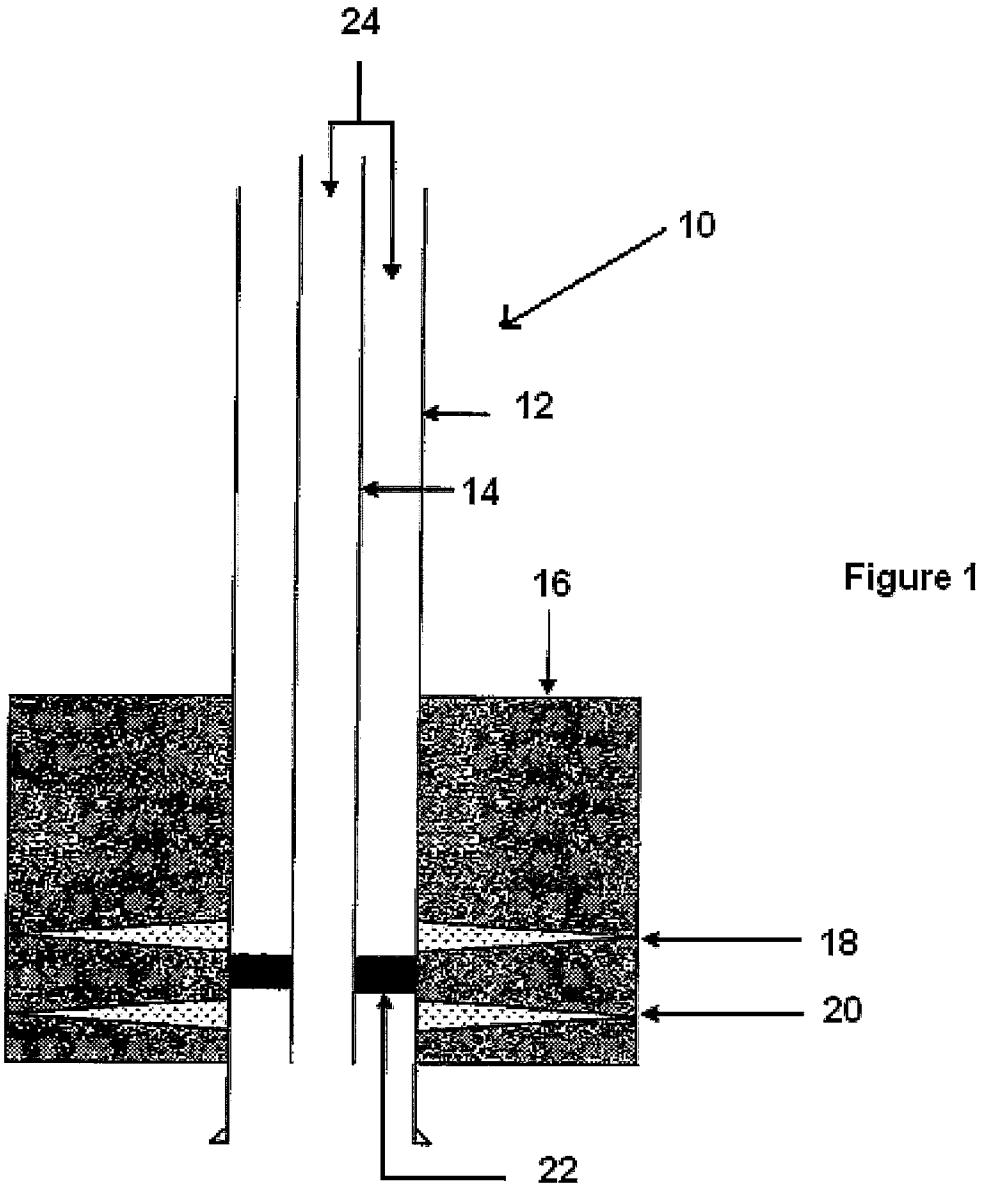
FIG. 1 depicts the startup process of the current method.

FIG. 1 depicts the startup process of the current method. The wellbore 10 can be drilled in a formation 16 where conventional Steam Assisted Gravity Drainage or Cyclic Steam Stimulation of the bitumen can be used. The use of only one wellbore is advantageous over the costs associated with conventional heavy only production methods which require at least two wells. Preferentially, the use of this method is done where there are shallowly buried oil sands or where there is minimal stress in the vertical direction. Shallowly buried oil sands are those typically that are buried less than 2,000 ft, 1,500 ft, 1,000 ft or even 750 ft into the ground. Although this method can be used in formations where there is one high permeability region and one low permeability region it is not limited to that type of formation. This method can be used in areas where there is only one permeability region.

In this embodiment the wellbore 10 has an outer casing 12 and a tubing string 14. In an alternate embodiment it is possible that multiple tubing strings are used. Additional tubing strings and additional packer systems can be placed above the upper fractures (18/19) to provide additional wellbore integrity.

In the formation 16 an upper horizontal fracture 18 and a lower horizontal fracture 20 are created in such a manner that communication is established between the wellbore 10 and the fractures. The creation of these fractures can be performed by a variety of different ways that are currently known. One method that is commonly used involves the injection of a viscous fluid above the parting or fracture pressure of the formation. In one embodiment these fractures are propped open using proppant material, such as sand, bauxite, metal fines/particles/shaving, or other course material that will provide a high permeability (multi-darcy), high porosity (>30%) conduit to the reservoir and high temperature allowing them to be used in thermal applications. It is desired but not required that the shape of these fractures be elliptical horizontal fractures. The size of these fractures may range from a ¼ inch or more in vertical thickness, and have a radius greater than 20 meters. The distance between the upper horizontal fracture 18 and the lower horizontal fracture 20 can vary between a low of 15 feet, to allow for sub-cool drainage control, to greater than 80 meters depending upon the reservoir and fluid properties.

Figure 2:
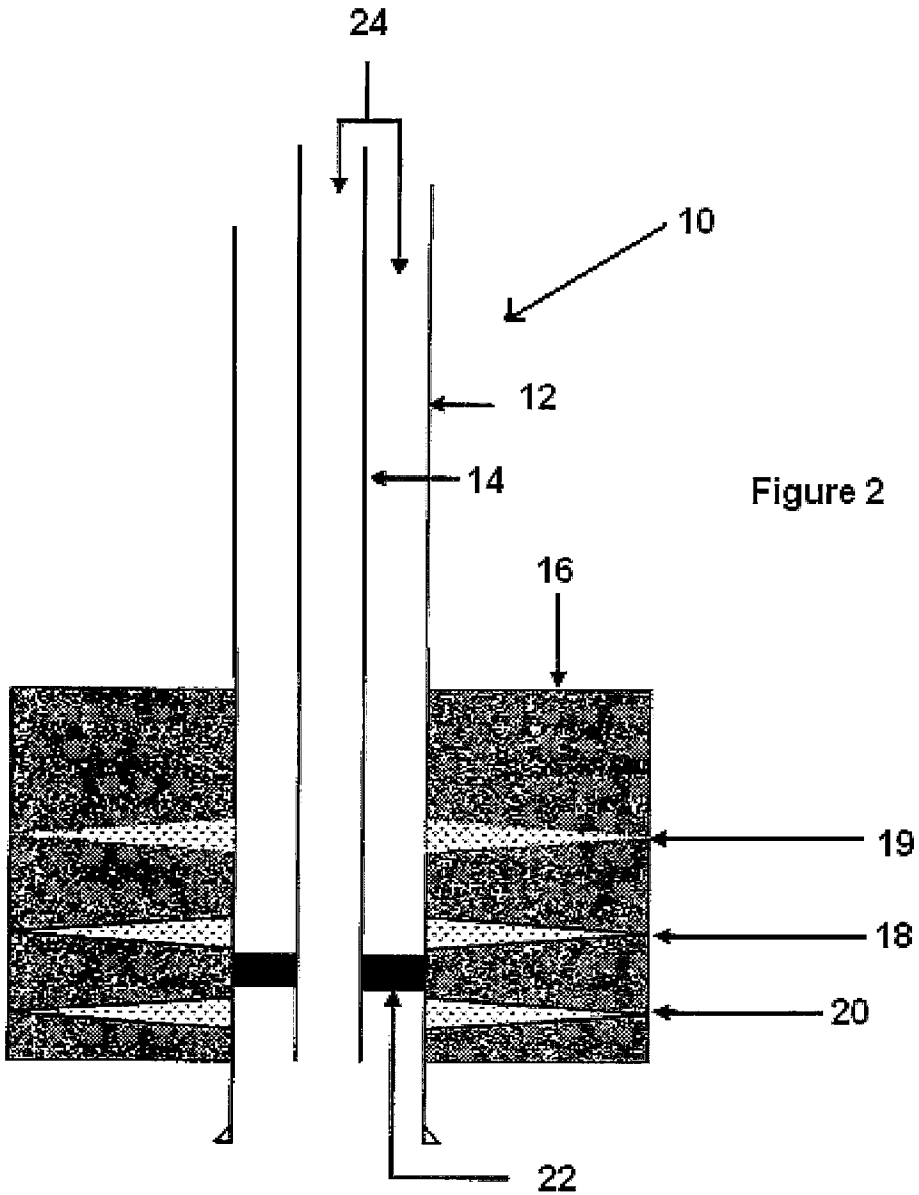
FIG. 2 depicts the startup process with two upper horizontal fractures.

FIG. 2 demonstrates one alternate embodiment where there is more than one upper horizontal fracture 19. The creation of additional upper horizontal fractures would depend upon the reservoir properties, and may be necessary in some reservoirs to provide sufficient heat to the formation to mobilize the heavy oil. This upper fracture could be spaced within 5 to 10 feet of the first upper fraction thus increasing the surface area of injection.

A retrievable packer 22 is placed in the wellbore 10 to isolate the upper horizontal fracture from the lower fracture. In this embodiment the packer is ideally a high temperature mechanical packer. In an alternate embodiment the packer is a polished bore receptacle in with a stinger and a seal assembly (metal to metal or Teflon™ or other high temperature material for thermal applications). The packer is manufactured from conventional oilfield materials (carbon steels) and can be tailored using prior art to corrosive conditions, such as acid gas production using alloys (Stainless, Hastoloy, Inconel, etc.). The packer or polish bore receptacle can be placed in the wellbore using standard oilfield operations practices. In one embodiment the packer or polished bore receptacle is vertically movable in the wellbore.

To heat the fracture and induce flow of the heavy oil, steam 24 is injected both into the tubing and the casing. The resultant steam would then flow into both the upper horizontal fracture and the lower horizontal fracture. Steam can be continuously pumped into the wellbore till fluid communication is established between the upper horizontal fracture and the lower horizontal fracture. In one embodiment the thermal zone for the heat from the steam would flow between the upper horizontal fracture and the lower horizontal fracture. Conventional steam assisted drainage techniques can then be used produce oil from the tubing string.

The present method can be used with cyclic steam stimulation to produce heavy oil. In such a method steam will be injected into the tubing and the casing as part of the injection stage. The soaking stage can occur for any amount of time necessary to heat the formation. This is followed by production of the heavy oil through the tubing. When production slows the steps of the cyclic steam stimulation are repeated.

In an alternate embodiment the present method can be used with steam assisted gravity drainage. In this method the steam will flow into the upper horizontal fracture to heat the bitumen so that it flows into the lower horizontal fracture where the heavy oil will then be produced by pumping through the tubing. Subcool or steam-trap control will be maintained to prevent live steam production through the lower fracture.

In yet another embodiment the present method can be used with a solvent and/or a solvent assisted steam process. In this method the solvent is used to reduce the viscosity of the crude oil so that it flows more easily. In this embodiment the solvents can be condensable, non-condensable or combinations of solvents comprising of carbon-dioxide, propane, butane and pentane.

Accordingly, the scope of protection is not limited by the description set out above, but is only limited by the claims which follow, that scope including all equivalents of the subject matter of the claims. Each and every claim is incorporated into the specification as an embodiment of the present invention. Thus the claims are a further description and are an addition to the preferred embodiments of the present invention. The discussion of any reference is not an admission that it is prior art to the present invention, especially any reference that may have a publication date after the priority date of this application.

The invention claimed is:

1. A method for steam assisted gravity drainage production, comprising:

a) drilling, casing and inserting a tubing string in a wellbore;

b) perforating both an upper portion and a lower portion of the casing and forming an upper horizontal fracture and a lower horizontal fracture to establish communication between the wellbore with the upper horizontal fracture and the lower horizontal fracture;

c) inserting a retrievable packer or a seal assembly horizontally between the tubing string and the casing and vertically between the upper horizontal fracture and the lower horizontal fracture for isolation;

d) injecting steam into the wellbore both into the upper horizontal fracture and the lower horizontal fracture; and e) producing heavy oil from the lower horizontal fracture while injecting steam into the upper horizontal fracture and maintaining subcool drainage control to prevent steam production through the lower horizontal fracture that would otherwise occur due to distance between the fractures without the subcool drainage control.

2. The method of claim 1, wherein the wellbore is drilled less than 1000 ft.

3. The method of claim 1, wherein the upper horizontal fracture and the lower horizontal fracture are held open with proppants.

4. The method of claim 1, wherein the retrievable packer is a high temperature mechanical steel packer or a polished bore receptacle with a stinger and a seal assembly.

5. The method of claim 1, wherein the packer is vertically movable in the wellbore.

6. The method of claim 1, wherein the steam independently heats the upper horizontal fracture and the lower horizontal fracture.

* * * * *